US006612923B1

(12) United States Patent
Flynn

(10) Patent No.: US 6,612,923 B1
(45) Date of Patent: Sep. 2, 2003

(54) WARM TUBE MIXING BOX

(76) Inventor: Brian M Flynn, 118 Twining Rd., Oreland, PA (US) 19075

( * ) Notice: Subject to any disclaimer, the term of this patent is extended or adjusted under 35 U.S.C. 154(b) by 0 days.

(21) Appl. No.: 10/252,099

(22) Filed: Sep. 23, 2002

(51) Int. Cl.[7] ..... F24F 13/04
(52) U.S. Cl. ..... 454/265; 454/261
(58) Field of Search ..... 454/261, 265, 454/266, 267, 268, 269

(56) References Cited

U.S. PATENT DOCUMENTS 2,400,617 A * 5/1946 Wheeler ..... 454/266
5,463,967 A * 11/1995 Gielow et al. ..... 110/104 R
5,632,675 A * 5/1997 Kanninen et al. ..... 454/264
6,106,386 A * 8/2000 Schwarz ..... 454/143
6,139,425 A * 10/2000 Yazici et al. ..... 454/261
6,478,671 B2 * 11/2002 Murai et al. ..... 454/156

* cited by examiner

*Primary Examiner*—Derek Boles
(74) *Attorney, Agent, or Firm*—LaMorte & Associates

(57) ABSTRACT

A mixer box for mixing two separate sources of air. Air from a first source is fed into a plurality of vented conduits. Each of the vented conduits has at least one vent opening, that allows the air from within the conduits to escape and enter a mixing chamber. Air from a second air source flows into the mixing chamber around the vented conduits. As the second air source flows around the vented conduits, turbulence is produced that mixes the second air source with the first air source escaping from the vented conduits. Flaps are used to control the flow of the first source of air out of the vented conduits and the flow of the second source of air around the vented conduits.

16 Claims, 4 Drawing Sheets

WARM TUBE MIXING BOX

BACKGROUND OF THE INVENTION

1. Field of the Invention

The present invention relates to mixing boxes used in heating, ventilation and air conditioning (HVAC) systems to mix recycled air from within a building with fresh air from outside the building.

2. Prior Art Statement

Most all modern office buildings, shopping centers and other large buildings that are typically occupied by people have HVAC systems that regulate the temperature and the quality of the air that is circulated within that building. In addition to either heating or cooling the air within a building, HAVC systems must also introduce fresh air into the air being circulated. The amount of fresh air that must be introduced into a particular building is subject to numerous engineering standards and governmental regulations.

Seldom is the fresh air outside a building the same temperature as the air being circulated within that building. Consequently, when fresh air is introduced into the ventilation system of a building, that fresh air must either be heated or cooled to the temperature of the air being circulated within the building.

In order to mix recycled air with fresh air, both the recycled air and the fresh air are passed through a mixing box. In the mixing box, the two air flows are given the opportunity to mix. The mixed air is then either heated or cooled to the requirements of the building. A key to an efficient HVAC system is the ability to introduce fresh air into the ventilation cycle while minimizing the energy required to either heat or cool the newly introduced air. Although a number of air mixers have been developed for bringing together and mixing fresh air with recycled air, such air mixers tend not to be very efficient in thoroughly mixing all the air. Furthermore, due to the air flow requirements of many large buildings, air mixers are commonly made quite large. The air mixers, therefore, take up a substantial amount of space.

An air mixing chamber is typically the first part of a HVAC unit. The mixed air from the mixing chamber is then passed through heat exchanger coils that are used to cool the mixed air during warm weather. A problem with such a configuration commonly occurs in the winter, during cold temperature conditions. In the winter, the air conditioning unit of the HVAC system is dormant. Consequently, the water or other fluid held within the heat exchanger coils does not circulate as the mixed air flows past the heat exchanger coils. During period of cold weather, the temperature of the fresh air outside a building may be significantly colder than the air circulated within the building. For example, the air on a winter day may be 10 degrees, while the temperature within a building may be 70 degrees. A temperature gradient of 60 degrees therefore exists between the external fresh air and the recycled internal air.

When a large temperature gradient exists between the fresh air and the recycled air, the two temperatures of air tend to stratify within the confines of an air mixer. That is, when the cold fresh air and the warm recycled air are introduced into an air mixer, the cold air tends to sink to the bottom of the mixer and the warm air rises to the top of the mixer. Due to the large temperature gradient between the two flows of air, very little mixing of the air flows actually occurs.

Due to the stratification of the warm and cold air, the temperature of the air at the bottom of the air mixer is little warmer than the external air drawn into the air mixer. The air exiting the air mixer is therefore not well mixed and is not at the proper temperature.

In the worst case scenario, as the cold layer of stratified air in the air mixer flows past the heat exchanger coils next to the air mixer, the cold air can freeze the fluid in the heat exchanger coils and damage the heat exchanger coils. To prevent this scenario from happening, temperature sensors are placed near the heat exchanger coils. If the temperature sensor detects an air temperature that can damage the heat exchanger coil, the unit is automatically shut down. Consequently, on unusually cold days in the winter, it is not uncommon for many different HVAC units to shut down due to poor air mixing.

Various solutions have been proposed in the past to prevent air stratification in an air mixer and to prevent the damage that it can cause to the system. For example, glycol additives have been used to prevent heat exchange coils from freezing. Although such additives may prevent frozen coils, they have reduced heat transfer coefficients and therefore require more pump energy. Dampers and high velocity jets have also been used to help in the mixing of air streams, but often the use of such devices creates unacceptable levels of pressure drop in the system. Specially designed air mixers have also been proposed in the past and these can improve the mixing of the air streams. However, these known mixers have some inherent defects which can be caused by the air streams being forced to pass through a narrow cross-section of the mixer. These known air mixers generally require more downstream space, can create a non-uniform downstream velocity profile and can cause a high pressure drop across the mixer. In addition, a non-uniform velocity profile caused by the air mixer can generate an extra pressure drop at downstream filter and coil sections.

In an attempt to increase the mixing that occurs in an air mixer, air mixers have been developed that create a great deal of turbulence between the incoming warm air and the incoming cold air. By increasing the turbulence, greater air mixing is achieved. However, such prior art air mixers simply use static baffles to create the turbulence in the air flow. As such, the amount of turbulence depends upon the volume of air flow. In conditions where there is a large temperature gradient and a small intake flow, such systems are no more effective than conventional air mixer configurations. Such prior art air mixers that use static baffles are exemplified by U.S. Pat. No. 6,139,425 to Yazici, entitled High Efficiency Air Mixer.

A need therefore exists for an improved air mixer that can mix two different sources of air at differing temperatures in a highly space efficient and energy efficient manner without having to depend upon air flow volume to create turbulence. This need is met by the present invention as described and claimed below.

SUMMARY OF THE INVENTION

The present invention is a mixing box for mixing two separate sources of air. The mixing box defines a mixing chamber. Air from a first source is fed into a plurality of vented conduits. Each of the vented conduits has at least one vent opening, that allows the air from within the conduits to escape and enter the mixing chamber. Air from a second air source flows into the mixing chamber around the vented conduits. As the second air source flows around the vented conduits, turbulence is produced that mixes the second air source with the first air source escaping from the vented conduits.

Flaps are used to control the flow of the first source of air out of the vented conduits and the flow of the second source of air around the vented conduits. The flaps are selectively positionable between a first position and a second position. When in a first position, the flaps restrict the flow of the first air source out of the vent openings in the vented conduits. When moved toward the second position, the same flaps no longer obstruct the flow of the first air source out of the vented conduits, but now obstruct the flow of the second air source around the vented conduits. By selectively controlling the position of the flaps, the relative flow of air into the mixing chamber from the first air source and the second air source can be dynamically controlled.

BRIEF DESCRIPTION OF THE DRAWINGS

For a better understanding of the present invention, reference is made to the following descriptions of exemplary embodiments thereof, considered in conjunction with the accompanying drawings, in which.

DETAILED DESCRIPTION OF THE DRAWINGS

Figure 1:
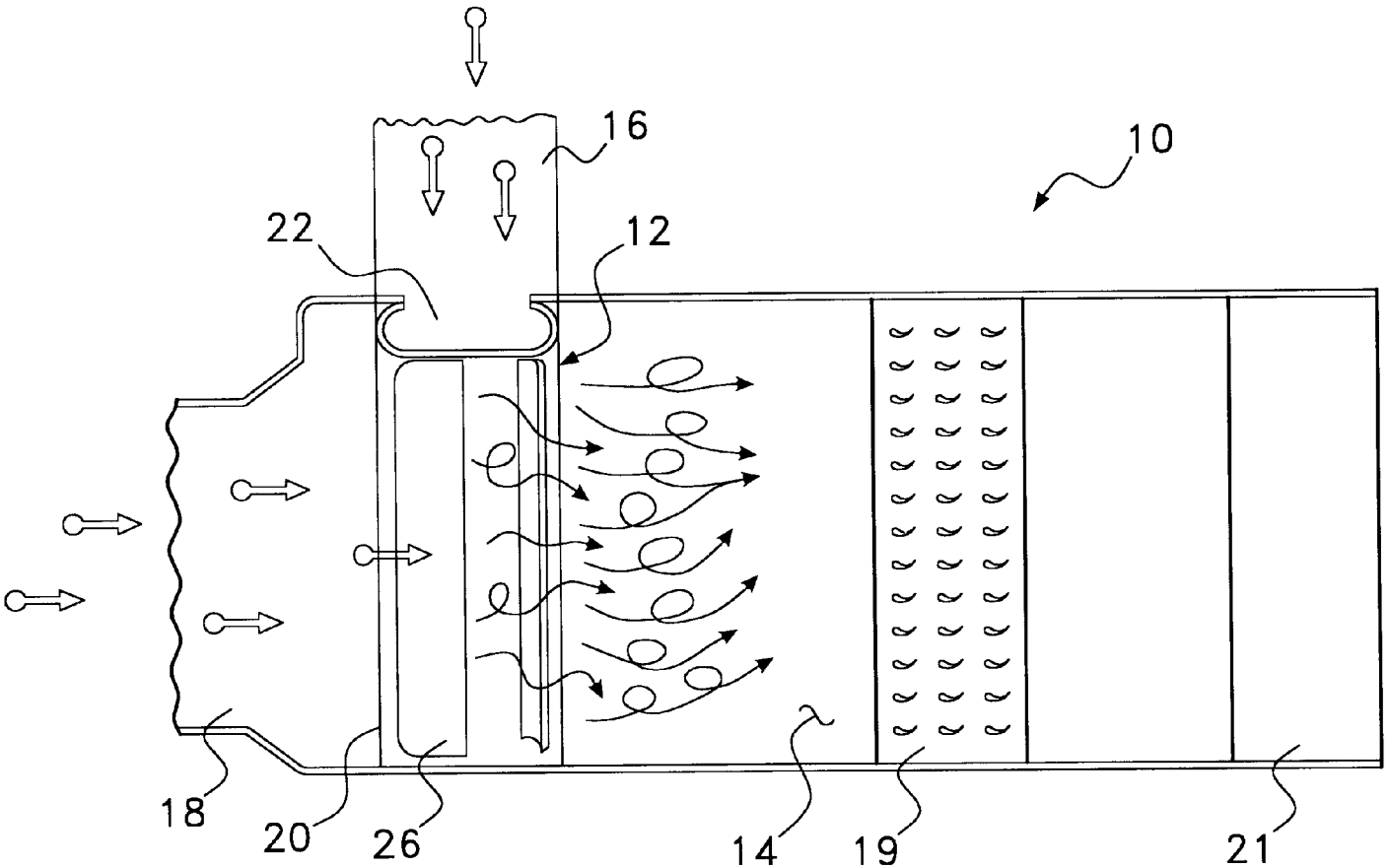
FIG. 1 is a schematic view of part of a HVAC system containing a mixer box configuration in accordance with the present invention.

Referring to FIG. 1, an operation schematic of a segment of a HAVC system 10 is shown that contains an embodiment of the present invention air mixing assembly 12. The segment of the HVAC system 10 illustrated is the coil access section that contains the mixer box 14. A recycled air conduit 16 and a fresh air conduit 18 are connected to the mixer box 14. The recycled air conduit 16 lets recycled air from within a building flow into the mixer box 14. The fresh air conduit 18 enables fresh ambient air to enter the mixer box 14. The recycled air and fresh air do not enter directly into the mixer box 14. Rather, both the recycled air and the fresh air pass through the structure of the air mixing assembly 12, as will be later explained. The air mixing assembly 12 mixes the recycled air with the fresh air in a manner that greatly reduces stratification. The mixed air can then flow past the heat exchanger coils 19 within the segment of the HVAC system 10, without freezing or otherwise damaging the heat exchanger coils 19. The properly mixed air is then drawn into the ventilation system by a fan 21.

From FIG. 1, it can be seen that the air mixing assembly 12 includes a manifold 22 that receives the air from the recycled air conduit 16. A plurality of vented conduits 20 extend downwardly from the manifold 22 to the bottom of the mixer box 14. Consequently, as fresh air enters the mixer box 14, that air must flow between the various vented conduits 20.

Figure 2:
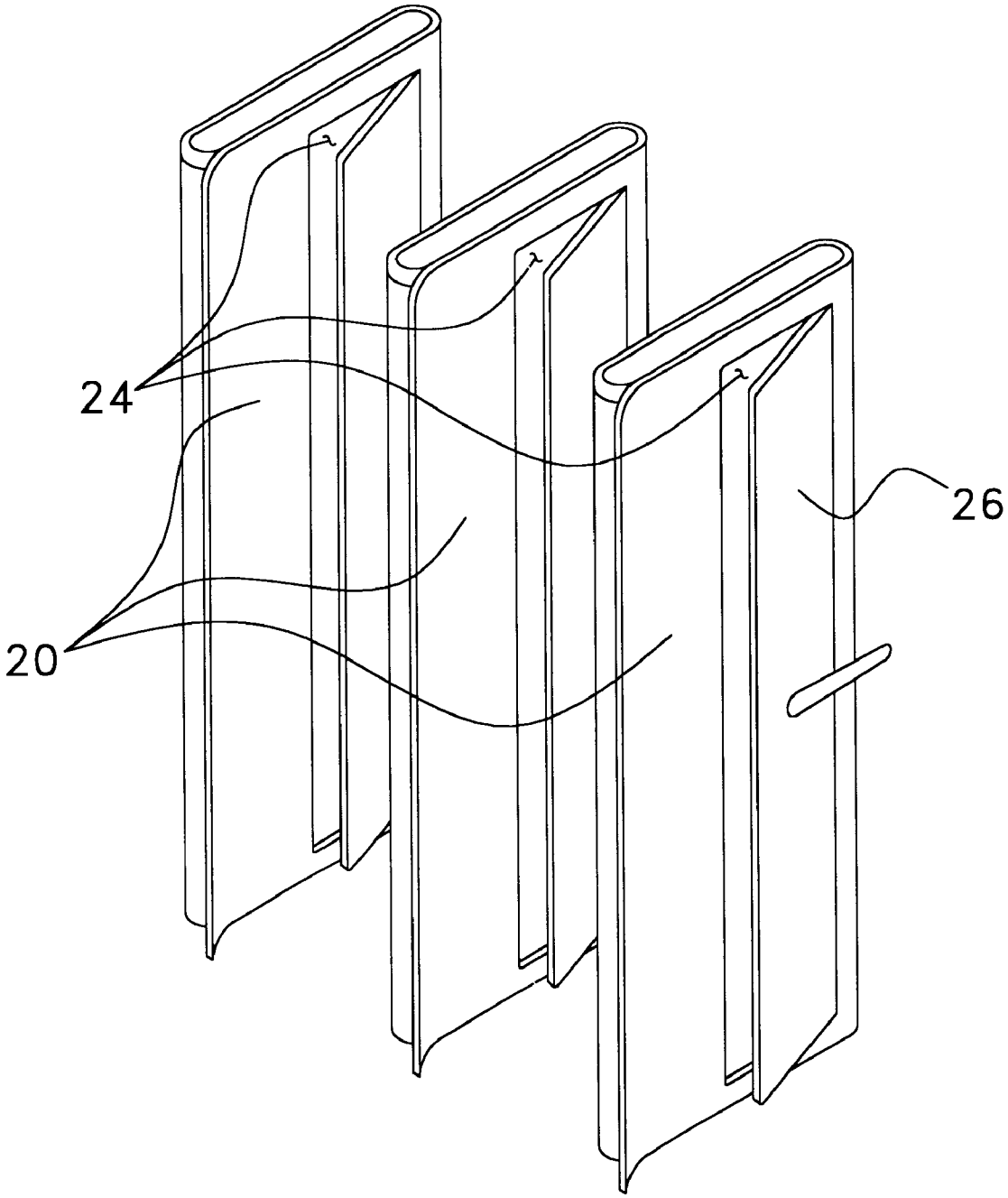
FIG. 2 is a fragmented perspective view of the structure of the vented conduits of the mixer box.

Referring to FIG. 2, it can be seen that each of the vented conduits 20 is a tubular structure. As such, the recycled air received by the manifold 22 (FIG. 1) flows into the various vented conduits 20. Each of the vented conduits 20 is oblong in cross-sectional shape so as to provide an aerodynamic structure that does not significantly obstruct the flow of air around and between the exterior of the vented conduits 20.

On at least one side of each of the vented conduits 20 is a vent opening 24. The vent opening 24 is an opening in the peripheral wall of the vented conduit 20 that enables the recycled air from within the vented conduit 20 to exit the confines of the vented conduit 20. The vent opening 24 extends the length of the vented conduit 20. The vent openings 24 can be totally opened or can be a matrix of perforations or mesh, that provides little resistance to the passage of air.

Each vent opening 24 is covered by a flap 26. The flaps 26 are selectively positionable between a closed position and an open position. When in the closed position, the flaps 26 cover the vent openings 24 and prevent any significant flow of air from exiting the interior of the vented conduits 20. Furthermore, when the flaps 26 are in the closed position, the flaps 26 do not interfere with the aerodynamics of the vented conduits 20 as fresh air flows around and between the vented conduits 20.

Figure 3:
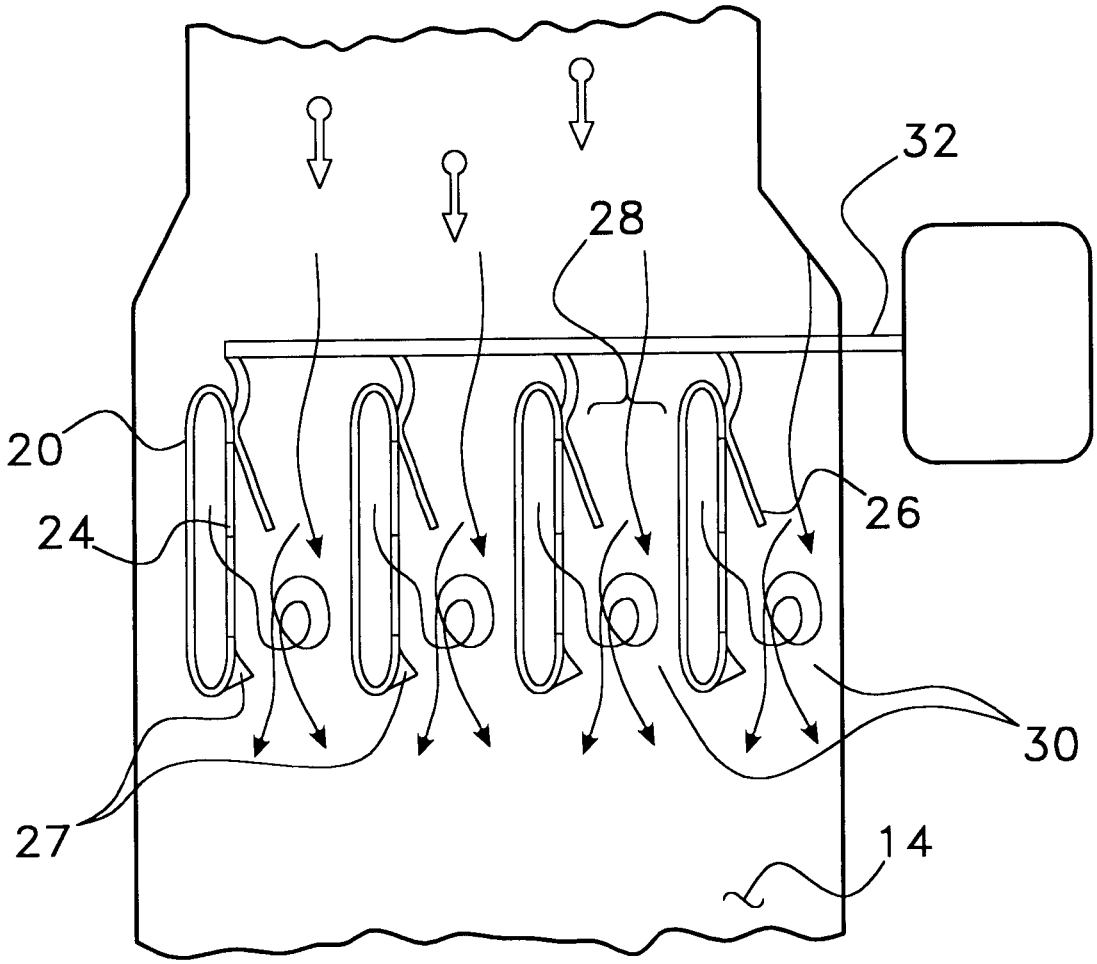
FIG. 3 is top cross-sectional view of the vented conduits of the mixer box.

Referring to FIG. 3, it can be seen that when the flaps 26 are open, the flaps 26 extend into the space 28 between the vented conduits 20. This reduces the area available between the vented conduits 20 through which fresh air can flow. However, when the flaps 26 are opened, each flap 26 forms part of a funnel shape that concentrates the flow of the fresh air, thereby increasing the velocity and pressure of the fresh air just as it passes the flap 26. When fully opened, the flaps can fully obstruct the passage of fresh air between the vented conduits 20.

At least one deflection foil 27 is present on the exterior of the vented conduits 20 behind the vent opening 24. The presence of the deflection foil 27 helps disrupt laminar flow along the exterior surface of the vented conduit 20 and increase turbulence between the vented conduits 20.

As the fresh air passes the edge of the flap 26, a turbulence region 30 is created just behind the flap 26. It is into this turbulence region 30 that recycled air from within the vented conduits 20 flows. The turbulence created by the flow of the fresh air past the flaps 26 is increased by the turbulence of the recycled air out of the vented conduits 20. This combined turbulence creates a condition of optimum mixing between the flow of the recycled air from inside the vented conduits 20 and the flow of fresh air around the vented conduits 20.

The turbulent mixing between the recycled air and the fresh air is further helped by the presence of the deflection foils 27 that direct flowing air into the turbulence region 30. The turbulence is further promoted by convection flows in the mixing air. Since the recycled air flows down the vented conduits 20 and out the vent openings 24, much of the recycled air is introduced into the mixer box 14 at an elevation below that of the in-flowing fresh air. As a result, convection causes the recycled air to rise through the turbulent flow, thereby adding even a greater degree of mixing between the recycled air and the fresh air.

In the prior art, the volume of flow for the fresh air into a mixer box is controlled by a first damper control. Similarly, in the prior art, the volume of flow and the flow for the recycled air into a mixer box is controlled by a second damper control. By regulating the first damper control and the second damper control, the ratio between the recycled air and the fresh air can be selectively controlled.

In the embodiment of the present invention, the use of two separate damper controls is eliminated. In the present invention, each of the flaps 26 is connected to a control rod 32. When the control rod 32 is moved in one direction, all the flaps 26 all open in unison. Conversely, when the control rod 32 moves in the opposite direction, all the flaps 24 close in unison. As the flaps 26 open, the flow of recycled air into the mixer box 14 increases and the flow of fresh air into the mixer box 14 decreases. Accordingly, by selectively controlling the degree to which the flaps are opened, the ratio of recycled air to fresh air in the mixer box 14 can be selectively controlled.

The opening and the closing of the flaps 26 is controlled by a single control mechanism 36. The control mechanism 36 is connected to the environmental controls of the HVAC system. The control mechanism 36 can be any electromechanical mechanism that can selectively move the control rod 32 laterally to alter the position of the flaps 26 between a full open position and a full closed position.

Figure 4:
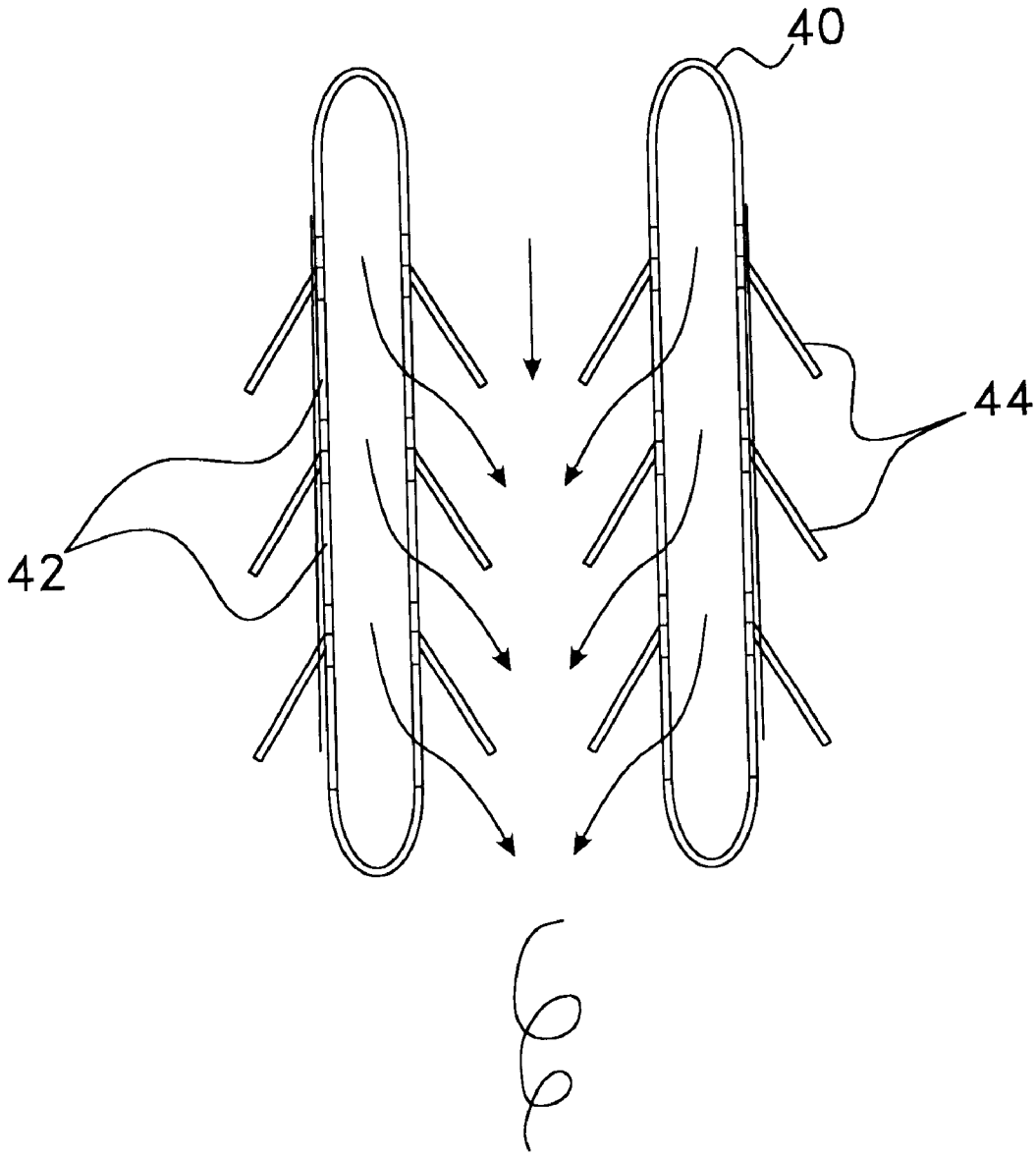
FIG. 4 is a top cross-sectional view of an alternate embodiment of the vented conduits of the mixer box.

In the embodiment of the mixer assembly previous shown, only one vent opening 24 exists on each vented conduit 20 and that vent opening 24 is selectively covered by one flap 26. Such an embodiment is merely exemplary and it should be understood that a vent conduit 20 can have more than one vent opening and for each vent opening, more than one flap can be used. Referring to FIG. 4, such an alternate embodiment of a mixer box is shown. In the embodiment of FIG. 4, an elongated vent conduit 40 is shown. The vent conduit 40 contains a plurality of vent openings 42 disposed on more than one side of the vent conduit 40. Each vent conduit 40 can be covered by a louver structure that contains more than one flap 44.

As with the previous embodiment, as the flaps 44 open, the flaps 44 narrow the area between the vented conduits 40. The flaps 44 cause turbulence in the flow of both the recycled air exiting the vented conduits 40 and the fresh air flowing past the vented conduits 40. Consequently, mixing occurs in the manner previously described. Furthermore, by selectively opening and closing the flaps 44, the ratio of mixture between the recycled air in the vented conduits 40 and the fresh air flowing around the vented conduits 40 can be controlled.

It will be understood that all of the embodiments of the present invention illustrated and described are merely exemplary and that the present invention can be practiced in a variety of different ways other than what is shown. For example, the shape, size and number of vented conduits can be changed. Similarly, the number of vent openings, vent flaps and the mechanism used to open and close the vent flaps can also be altered. All such modifications and alternate embodiments are intended to be covered by the scope of the claims presented below.

What is claimed is:

1. An air mixer assembly for mixing flows from a first source of air and a second source of air, said assembly comprising:

a mixing chamber;

a plurality of vented conduits, wherein open areas exist between each of said vented conduits, each of said vented conduits having walls that define an interior space and at least one vent opening in at least one of said walls;

at least one flap for regulating said at least one vent opening;

wherein the first source of air flows into said interior space of said vented conduits and out into said mixing chamber through said at least one vent opening; and wherein the second source of air flows into said mixing chamber through said open areas between said vented conduits.

2. The assembly according to claim 1, wherein said at least one flap is selectively positionable between an closed position and an open position, said at least one flap extending into said open areas between said vented conduits when not in said closed position.

3. The assembly according to claim 1, wherein said at least one flap extends further into said open areas between said vented conduits as said vent flap moves from said closed position to said open position.

4. The assembly according to claim 1, wherein said plurality of vented conduits are arranged in parallel, therein defining uniform open spaces between said vented conduits.

5. The assembly according to claim 1, further including a control mechanism for selectively moving said at least one flap between said open position and said closed position.

6. The assembly according to claim 1, further including at least one deflection flap on each of said vented conduits behind each said vent opening.

7. A mixer box for mixing a first source of air and a second source of air, said mixing box comprising:

a mixing chamber;

at least one vented conduit that internally receives air from said first source of air, said at least one vented conduit defining at least one vent opening that enables air from said first source of air to flow out of said at least one vented conduit and into said mixing chamber;

wherein air from said second source of air flows into said mixing chamber around said at least one vented conduit; and at least one flap selectively positionable between a first position, where said at least one flap at least partially restricts the flow of said first source of air into said mixing chamber and a second position, where said at least one flap at least partially restricts the flow of said second source of air into said mixing chamber.

8. The mixer box according to claim 7, further including a controller for selectively moving said at least one flap to maintain a predetermined mixture ratio of said first source of air and said second source of air in said mixing chamber.

9. The mixer box according to claim 7, having a plurality of vented conduits, wherein open spaces are defined between said plurality of vented conduits through which air from said second source of air flows.

10. The mixer box according to claim 9, wherein said at least one flap extends into at least one of said open spaces when said at least one flap is not in said first position.

11. A method of regulating the flows of two separate sources of air into a mixer box, comprising the steps of:

directing the flow of a first source of air into at least one vented conduit, wherein said at least one vented conduit defines at least one vent opening out of which said first source of air can flow into said mixer box;

directing said second source of air around said vented conduits and into said mixer box;

providing flaps;

selectively adjusting said flaps to actively regulate the flow of said first source of air and said second source of air into said mixer box.

12. The method according to claim 11, wherein said flaps are controlled by a single control mechanism and are controlled in unison by said control mechanism.

13. The method according to claim 11, wherein said flap at least partially obstructs the flow of said first source of air out of said at least one vent opening, when in a first position, and at least partially obstructs the flow of said second source of air around said vented conduits when in a second position.

14. The method according to claim 13, further including the step of regulating a ratio between said first source of air and said second source of air received by said mixer box by selectively adjusting said flaps between said first position and said second position.

15. The method according to claim 11, wherein said first source of air is at a first temperature and said second source of air is at a second temperature.

16. The method according to claim 15, further including the step of maintaining a predetermined range of temperature in said mixer box by regulating said first source of air and said second source of air with said flaps.

* * * * *